US012535293B2

(12) United States Patent
Estell et al.

(10) Patent No.: US 12,535,293 B2
(45) Date of Patent: Jan. 27, 2026

(54) APPARATUS FOR CARRYING CONCEALED WEAPONS

(71) Applicant: Agonic LLC, Clarksville, TN (US)

(72) Inventors: Drew B. Estell, Clarksville, TN (US); Mitchell T. Wiuff, Vilonia, AR (US)

(73) Assignee: AGONIC LLC, Clarksville, TN (US)

( * ) Notice: Subject to any disclaimer, the term of this patent is extended or adjusted under 35 U.S.C. 154(b) by 677 days.

(21) Appl. No.: 17/890,939

(22) Filed: Aug. 18, 2022

(65) Prior Publication Data

US 2023/0059568 A1 Feb. 23, 2023

Related U.S. Application Data

(60) Provisional application No. 63/234,468, filed on Aug. 18, 2021.

(51) Int. Cl.
*F41C 33/04* (2006.01)
*A45F 5/02* (2006.01)

(52) U.S. Cl.
CPC ..... *F41C 33/048* (2013.01); *A45F 5/021* (2013.01)

(58) Field of Classification Search
CPC .... F41C 33/046; F41C 33/048; F41C 33/041; A45F 5/021; A45F 2003/144
USPC ..... 2/321, 323, 318, 320, 338
See application file for complete search history.

(56) References Cited

U.S. PATENT DOCUMENTS

| | | | | |
|---|---|---|---|---|
| 3,076,463 | A * | 2/1963 | Vorsteher | A41F 1/006 2/325 |
| 5,806,731 | A * | 9/1998 | Mark | F41C 33/048 2/300 |
| 9,581,414 | B1 * | 2/2017 | Mironski | F41C 33/046 |
| 11,470,950 | B2 * | 10/2022 | Hawkins | A45F 5/021 |
| 11,561,065 | B1 * | 1/2023 | Hoffman | F41C 33/046 |
| 2020/0214378 | A1 * | 7/2020 | Swan | A41F 9/007 |
| 2021/0137252 | A1 * | 5/2021 | Knudsen | B25H 3/00 |

* cited by examiner

*Primary Examiner* — Corey N Skurdal
(74) *Attorney, Agent, or Firm* — Eric B. Fugett; Mark A. Pitchford; Pitchford Fugett, PLLC

(57) ABSTRACT

An apparatus for supporting a concealed weapon on a waist of a user includes a first fastener, a second fastener, and a tongue support. The first fastener is configured to attach to a waistband which is configured to extend about the waist of the user. The second fastener is configured to attach to the waistband. The support tongue is configured to extend between the first fastener and the second fastener and attach to the waistband via the first and second fasteners. The support tongue is configured to receive and support a mount for the concealed weapon. When the support tongue is in an upright position, the support tongue is resiliently flexible in a horizontal direction and substantially rigid in a vertical direction.

20 Claims, 5 Drawing Sheets

APPARATUS FOR CARRYING CONCEALED WEAPONS

CROSS-REFERENCES TO RELATED APPLICATIONS

This application claims priority to U.S. Provisional Patent Application Ser. No. 63/234,468 filed on Aug. 18, 2021 entitled "BELT FOR CARRYING CONCEALED WEAPONS."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to carrying weapons. More specifically, the present invention relates to devices for supporting and concealing a holstered firearm, knife, or dagger, around the waist of a user.

Conventional concealed carry belts are typically made from a thick leather or a heavy synthetic material such as nylon, both of which are easily recognizable as such to even casual observation. Thick or heavy belts also tend to be very stiff and limit user mobility. Consequently, these types of belts are unsuitable for daily, continuous concealed carry. Currently available belts designed for concealed carry typically use thinner materials in an effort to disguise their functional, tactical purpose. However, the intrinsic mechanical properties of such materials permit these belts to flex when a firearm or knife is drawn from a holster attached thereto. Belt flexion produces undesirable holster movement during drawing of the firearm. Holster movement impairs user mobility and weapon accessibility when a user reaches for the firearm, and imposes a drag force on the firearm as it is being drawn, thereby slowing a user's ability to respond to a threat.

Additionally, available belts designed for carrying a concealed firearm inside the waistband obligate the user to cover the portion of the belt to which the holster is attached so as to hide the retaining clips or loops of the holster that would otherwise be visible on the outward surface of the belt.

Accordingly, what is needed are improvements in waistbands and belts for concealed carry.

BRIEF SUMMARY OF THE INVENTION

Aspects of the present invention provide a concealed carry apparatus including a substantially rigid and virtually motionless support structure for securing and stabilizing a holstered firearm or other weapon while carrying concealed a concealed weapon. The concealed carry apparatus includes a relatively stiff support tongue slidably attached to an inner surface of a flexible belt. The support tongue substantially immobilizes the holster during draw (i.e., substantially prevents the holster from moving or flexing during draw), thereby improving user mobility and reducing draw time and threat response time. The apparatus also provides improved concealment by concealing the retaining clips or mounting loops of a holster attached thereto from casual observation during wear.

In one aspect, an apparatus for supporting a concealed weapon on a waist of a user includes a first fastener, a second fastener, and a tongue support. The first fastener is configured to attach to a waistband which is configured to extend about the waist of the user. The second fastener is configured to attach to the waistband. The support tongue is configured to extend between the first fastener and the second fastener and attach to the waistband via the first and second fasteners. The support tongue is configured to receive and support a mount for the concealed weapon. When the support tongue is in an upright position, the support tongue is resiliently flexible in a horizontal direction and substantially rigid in a vertical direction.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
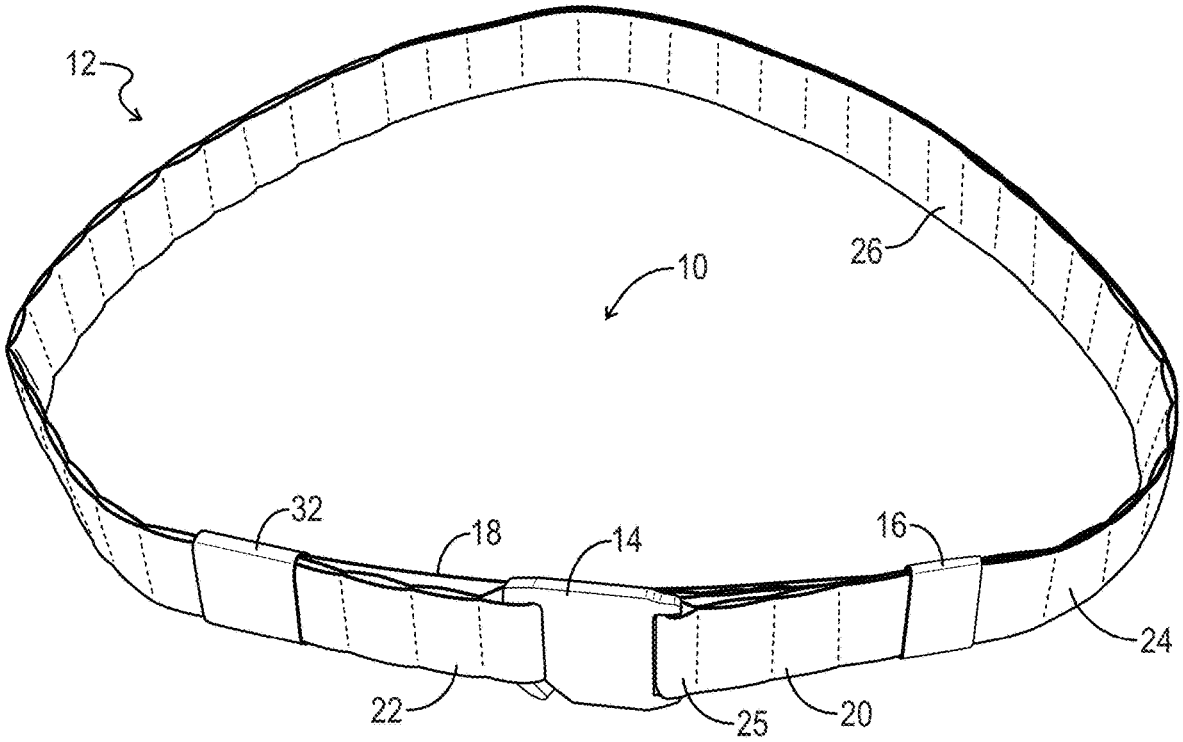
FIG. 1 is a front elevated perspective view of one embodiment of a concealed carry apparatus showing a concealed carry belt in a deployed configuration as the belt would be worn around the waist of a user and ready to mount a holster for a weapon, according to one embodiment of the invention.

As described herein, an upright position is considered to be the position of apparatus components while in proper operation or in a natural resting position as described herein. As used herein, the upright position of the belt is when being worn by a standing user such that the belt extends generally horizontally as shown in FIG. 1. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-9, in one embodiment, an apparatus 10 for supporting a concealed weapon for on a waist of the user includes a first fastener 16, a second fastener 32, and a support tongue 18. The first fastener 16 is configured to attach to a waistband 12 worn by the user. The waistband 12 is configured to extend about the waist of the user. The second fastener 32 is also configured to attach to the waistband 12. The support tongue 18 is configured to extend between the first fastener 16 and the second fastener 32 such that the support tongue 18 is supported on the waistband 12 by the first and second fastener 16, 32.

The support tongue 18 is configured to receive and support a mount 6 for the concealed weapon 4. When the support tongue 18 is in an upright position, the support tongue 18 is resiliently flexible in a horizontal direction and substantially rigid in a vertical direction. This permits the support tongue 18 to bend about the waist of the user while providing rigidity (which translates into limited motion and stability) when the weapon 4 is drawn from the apparatus 10 supporting the weapon 4. The upright position of the support tongue 18 is when worn by the user and the user is in a standing, generally vertical orientation. In one embodiment, when the support tongue 18 is in the upright position, the support tongue 18 is between 0.75 and 2.5 inches tall, between 4 and 20 inches long, and between 1/16 of an inch thick and 1/4 of an inch thick. In one embodiment, when in the upright position, the support tongue 18 is approximately 1.25 inches tall, 11.5 inches long, and 1/8 inch thick. In one embodiment, the support on 18 is formed of carbon fiber.

In one embodiment, the apparatus 10 further includes a belt 12 forming the waistband associated with the user when the user is wearing the apparatus 10. The belt 12 includes an inner surface 26, a first end portion 20, a second end portion 22 opposite the first end portion 20, and a buckle 14. The buckle 14 is configured to releasably secure the first end portion 20 and the second end portion 22 to one another. In one embodiment, the belt 12 is formed by overlapping 2 sections of flexible strap and securing the 2 sections of flexible strap to one another and spaced intervals along the length of the belt 12 to form anchor loops 34 along the length of the belt 12. In one embodiment, the belt 12 is formed from a single flexible strap folded lengthwise to form 2 overlapping sections of flexible strap which are secured to one another at spaced intervals along the length of the belt 12 to form anchor loops 34. In one embodiment, the 2 sections of overlapping flexible strap are secured to one another at spaced intervals by sewing the overlapping strap sections together transverse to the length of the belt 12. In one embodiment, the 2 sections of flexible strap are secured to one another at spaced intervals by sewing the overlapping strap sections together with columns of vertical stitches 36 transverse the length of the belt such that the anchor loops 34 are formed by the overlapping sections of flexible strap between each successive row vertical stitching 36. A plurality of the anchor loops 34 are configured to receive a portion of the buckle 14 therein to secure the belt 12 about the waist of the user. In one embodiment, the buckle 14 is e.g. hook, the flexible strap is inserted in the G hook 14 and folded lengthwise to capture the G hook 14 at the fold 25 in the flexible strap. In one embodiment, the flexible strap is elastic.

In one embodiment, the support tongue 18 has a first end 28 and a second end 30, and the second fastener 32 is attached to the support tongue 18 at the second end 30 of the support tongue 18. The first fastener 16, and the second fastener 32 are each one of clips, hooks, loops, or hook and loop systems. In one embodiment, the first fastener 16, and the second fastener 32 are loops configured to extend about the waistband. In one embodiment, the first fastener 16 is a keeper loop extending inward from the inner surface 26 of the belt 12 when the user is wearing the apparatus 10. The first fastener 16 is configured to receive the first end 28 of the support tongue 18 therein to attach the support tongue 18 to the belt 12 when the user is wearing the apparatus 10. In one embodiment, the first fastener 16 is a keeper loop extending about the belt 12 when the user is wearing apparatus 10 such that the first fastener 16 is slidable along the belt 12 between the first end portion 20 and the second end portion 22 of the belt 12.

In one embodiment, the second fastener 32 is affixed to the support tongue 18 at the second end 30 of the support tongue 18 and slidably engages the inner surface 26 of the belt 12. In one embodiment, the second fastener 32 is a mounting loop 32 affixed to the support tongue 18 at the second end 30 of the support tongue 18. The mounting loop 32 extends about the belt 12 such that the second fastener 32 and the support tongue 18 can be slid along the belt 12 between the first end portion 20 and the second end portion 22 of the belt 12.

In one embodiment, the support tongue 18 is angled at the first end 28 of the support tongue 18 such that the support tongue 18 is shorter along a bottom 301 of the support tongue 18 than along a top 303 of the support tongue 18. This promotes insertion of the first end 28 of the support tongue 18 into the first fastener 16 while maintaining rigidity during drawing of the concealed weapon 4. In one embodiment, a height of the belt 12 is greater than the height of the support tongue 18 when the user is wearing apparatus 10 (i.e., when the apparatus 10 is in the upright position).

In one embodiment, the concealed weapon is a holstered handgun 4, and the support tongue 18 is configured to receive the mount 6 of the holstered handgun for when the apparatus 10 is worn by the user. In one embodiment, the mount 6 is a retaining clip. In one embodiment, a space 27 is formed between the support tongue 18 and the inner surface 26 of the belt 12 when the apparatus 10 is worn by the user, and the retaining clip 6 is concealed from view when the apparatus 10 is being worn about the waist of the user and the holster 2 is attached to the support tongue 18 via the retaining clip 6.

In one embodiment, a concealed carry apparatus 10 for concealed carry is an apparatus for supporting a concealed weapon (e.g., firearm or knife) around the waist of a user. The concealed carry apparatus 10 includes a belt 12, a buckle 14 for releasably securing the belt 12 around the user's waist, a keeper loop 16, and a support tongue 18. The keeper loop 16 and the support tongue 18 are each slidably connected to the belt 12. The support tongue 18 is configured to provide a substantially rigid support structure to which a mount or retainer clip 6 for a handgun 4 or holster 2 can be securely attached when the concealed carry apparatus 10 is properly worn around the waist of the user in the manner typical of traditional belts.

In one embodiment, the belt 12 includes a first end portion 20 to which the buckle 14 is secured, a second end portion 22 having a free end 23, an outer surface 24, and an inner surface 26. The outer surface 24 and inner surface 26 are formed by overlapping sections of flexible strap. The keeper loop 16 is a flexible band positioned around the first end portion 20 of the belt 12. The keeper loop 16 is slidable along a length of the belt 12 from the first end portion 20 to the free end 23 of the second end portion 22.

In one embodiment, the support tongue 18 is a thin, elongated strip of stiff material which includes a free first end 28, a second end 30, and a flexible mounting loop 32 secured to the second end 30. The free end 23 of the belt 12 is receivable through the mounting loop 32 to slidably engage the support tongue 18 with the belt 12. As such, the support tongue 18 is slidable along the length of the belt 12 from the second end portion 22 to a terminal end 25 of the first end portion 20 where the buckle 14 is secured. The support tongue 18 is received against and thus slidably connected to the inner surface 26 of the second end portion 22 of the belt 12 when the second end portion 22 of the belt 12 is received through the mounting loop 32. The support tongue 18 is configured to stably support a holstered handgun 4 when the tongue 18 is received in the keeper loop 16 and the first and second end portions 20, 22 of the belt 12 are secured together (as best shown in FIG. 1) around a user's waist.

In one embodiment, when the support tongue 18 is received in the keeper loop 16 and the first and second end portions 20, 22 of the belt 12 are secured together (as best shown in FIG. 1) around a user's waist, a holster 2 for a firearm (see FIG. 8) equipped with retaining clips 6 or mounting loops (not shown) can be firmly fixed to the support tongue 18 by positioning the holster 2 against the user's abdomen (waist) with the retaining clips 6 between the support tongue 18 and the inner surface 26 of the belt 12 (i.e., wrapping around or clipping onto the support tongue 18). The support tongue 18 forms against the inner surface 26 of the belt a space 27 in which the retaining clip 6 of the holster 2 (or a retaining clip 6 mounted directly to a handgun 4, as exemplified in FIG. 9) is receivable to firmly fix the holster 2 (or handgun 4) to the support tongue 18 and conceal the holster and/or handgun 4 inside the user's waistband. Once the holster 2 is firmly fixed to the tongue 18, a handgun 4 can be safely stowed in and quickly drawn from the holster 2 with virtually no holster movement because the substantially rigid support tongue 18 immobilizes the holster 2 and thereby increases draw speed. In this way, a concealed carry apparatus 10 with a support tongue 18 disclosed herein provides an improved platform for securing and stabilizing a weapon (e.g., gun or knife) while carrying concealed.

The support tongue 18 can be formed from any sufficiently stiff material. By "sufficiently stiff material" it is meant that the support tongue 18 is formed from a material of sufficient stiffness that the tongue 18 is or becomes substantially rigid when received in the keeper loop 16 while the first and second end portions 20, 22 are secured together around the user's waist. When the concealed carry apparatus 10 is properly secured around a user's waist, the tongue 18 may flex slightly inward or outward (i.e., toward or away from the user's body) to suit the contours of the user's body, but does not flex upward or downward along the top 303 and bottom 301 edges of the support tongue 18. The lack of vertical flexion is what permits the support tongue 18 to form a substantially rigid mounting structure to which a holstered handgun can be firmly fixed. In some embodiments, the support tongue 18 itself can be formed from a substantially rigid, durable material, such as, for example, carbon fiber.

Figure 2:
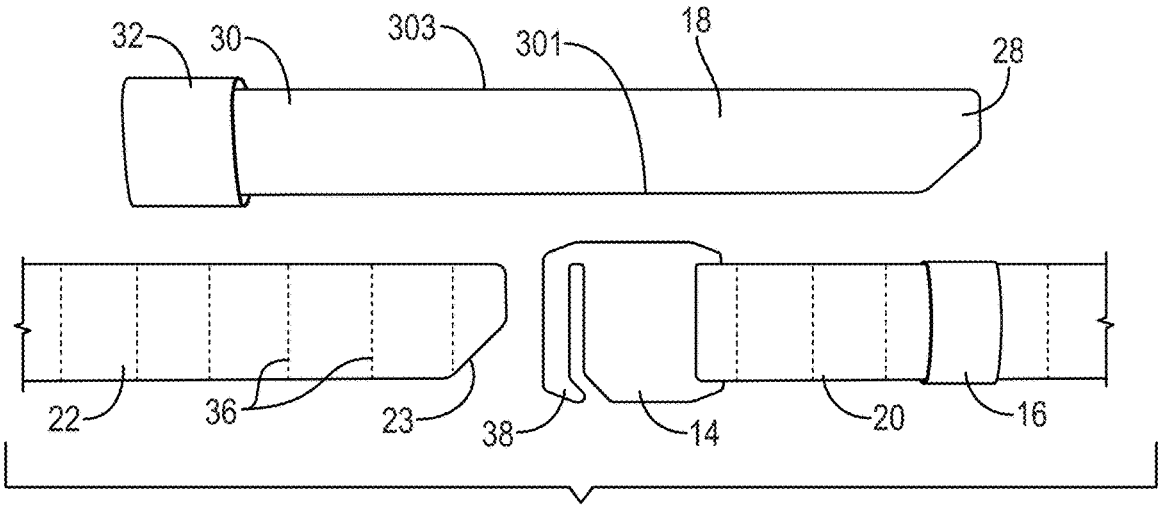
FIG. 2 is a partial front perspective view of exploded parts of the belt of FIG. 1.
Figure 3:
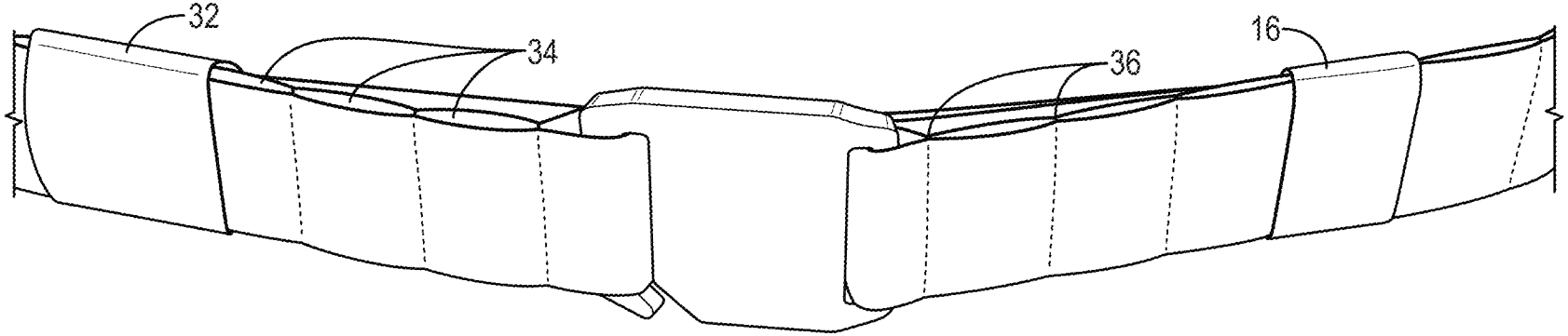
FIG. 3 is a magnified perspective detail view of the front of the belt of FIG. 1.
Figure 4:
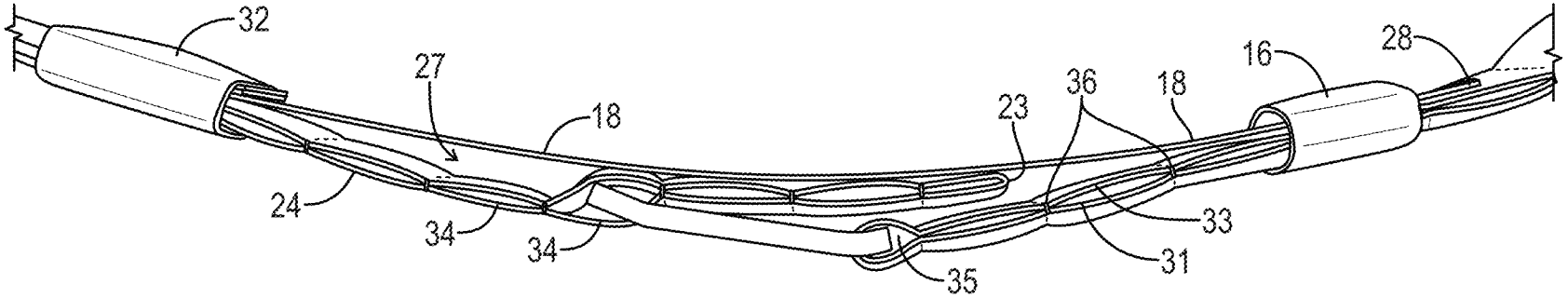
FIG. 4 is a top perspective view of the belt as shown in FIG. 3.
Figure 5:
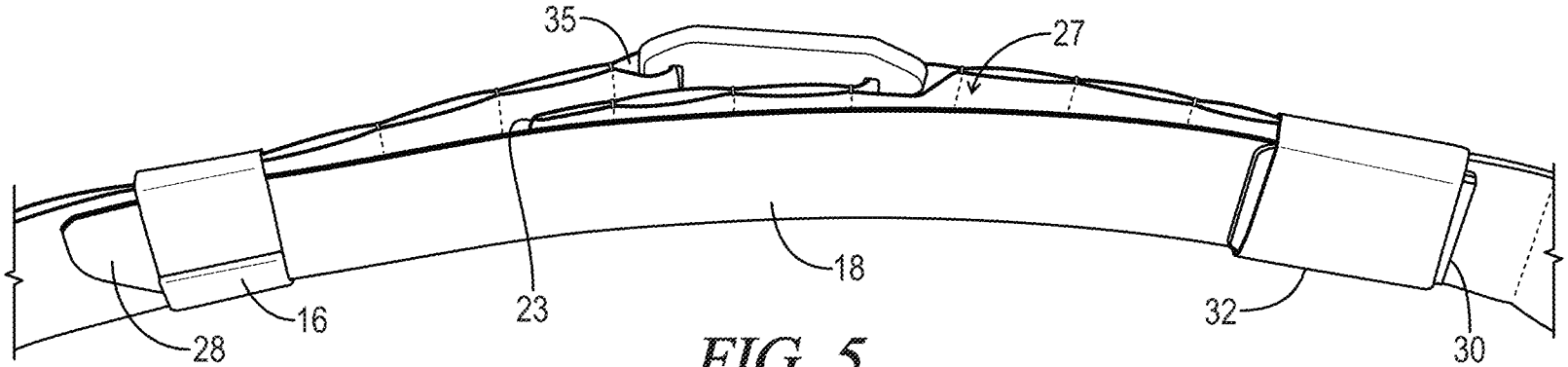
FIG. 5 is an elevated rear perspective view of the belt as shown in FIG. 3 with the first free end of the support tongue in the keeper loop.
Figure 6:
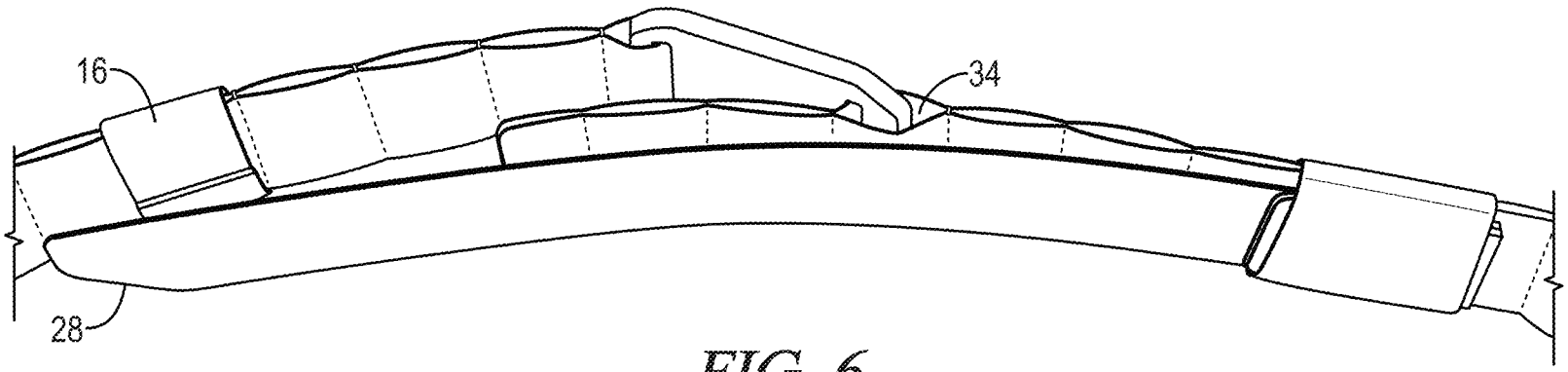
FIG. 6 is an elevated rear perspective view of the belt of FIG. 3 with the free first end of the support tongue removed from the keeper loop.
Figure 7:
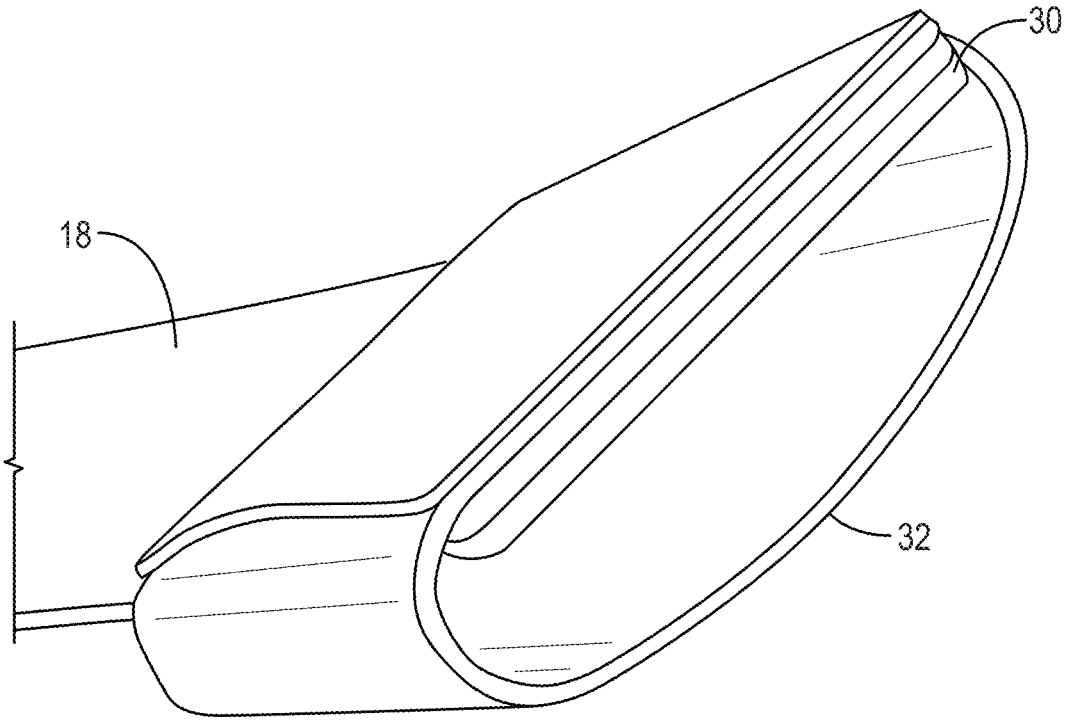
FIG. 7 is an isometric view of the second end of the support tongue.
Figure 8:
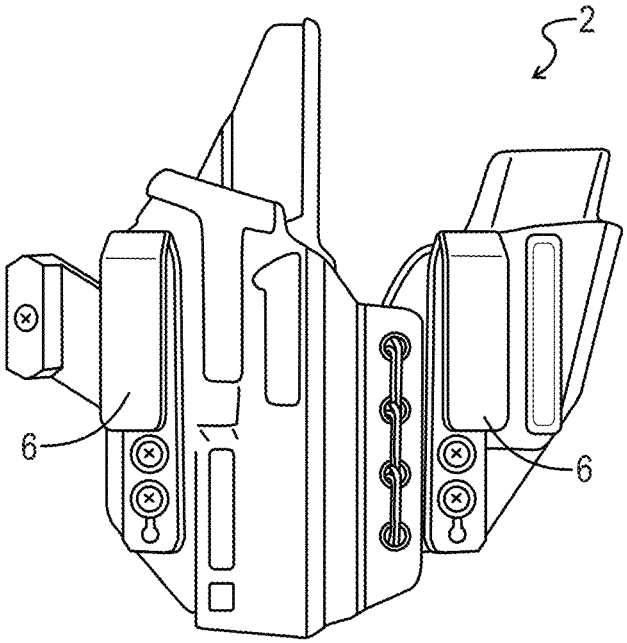
FIG. 8 is a front perspective view of an in the waistband holster for a handgun equipped with retaining clips typical of such holsters.

A material is "substantially rigid" in the context of the support tongue 18 if it does not flex upward or downward along the top and bottom edges of the material when the material is formed into the shape of a support tongue 18 (see FIG. 2). In some embodiments, the support tongue 18 can have a length of about 4 inches to about 20 inches. In one embodiment, the length of the support tongue 18 is about 11 inches. However, it is to be understood that the length of the support tongue 18 can be varied to suit the frame of a given user or the tactical application in which the concealed carry apparatus 10 is expected to be used.

The support tongue 18 also aids in concealment of a user's holster and/or firearm by concealing the retaining clip 6 of the user's holster 2 (see FIG. 8) or handgun 4 (see FIG. 9) between the support tongue 18 and the inner surface 26 of the belt 12. As such, when a concealed carry apparatus 10 of the present invention is properly worn around the waist of a user with a holster properly fixed to the tongue 18 as described herein, the retaining clip(s) of the holster will be concealed from casual observation behind the outer surface 24 of the belt 12. As such, the support tongue 18 can have a width which is the same as or less than a width of the belt 12 such that the retaining clip 6 of the holster 2 is better concealed by the belt 12 when the belt 12 is worn around the waist of the user and the holster 2 is supported on the support tongue 18. In one embodiment, the top 303 of the support tongue 18 is configured to be below a top of the belt 12 when the apparatus 10 is worn by the user to better conceal the retaining clip(s) 6.

The belt 12 can be formed from any suitably flexible material, including various natural and synthetic materials such as leather and/or nylon. In the embodiment depicted in FIGS. 1-7, the belt 12 is formed from a single flexible strap of nylon which has been folded in half to form two overlapping strap portions 31, 33 that are secured together at approximately 1.0 inch intervals to form a plurality of anchor loops 34 along the length of the belt 12. The anchor loops 34 extend transverse to the length of the belt 12. The overlapping portions of the strap are secured together by a plurality of spaced rows of vertical stitching 36 such that each anchor loop 34 is formed by 1.0 inch sections of the two overlapping portions of the strap located between adjacent rows of stitching 36. In this way, the belt 12 provides a plurality of attachment points for MOLLE gear. The term "MOLLE" is a well-known acronym used by the United States military that refers to modular light-weight load-carrying equipment (e.g., pouches for holding equipment such as magazines, binoculars, rations, and the like). The buckle 14 is received in and captured by a loop 35 formed at the terminal end 25 of the first end portion 20 of the belt 12 where the strap is folded in on itself.

The buckle 14 can be any kind of releasable fastener suitable to secure a belt around the waist of a user. In one embodiment, the buckle 14 is a rigid hook or buckle having a protrusion 38 that is receivable in any one of the anchor loops 34 to secure the terminal end 25 of the first end portion 20 of the belt 12 to an anchor loop 34 on the second end portion 22 of the belt 12. In an embodiment, the fastener is a rigid G-hook buckle 14. In one embodiment, a plurality of the anchor loops 34 are configured to receive the protrusion 38 of the buckle 14.

Figure 9:
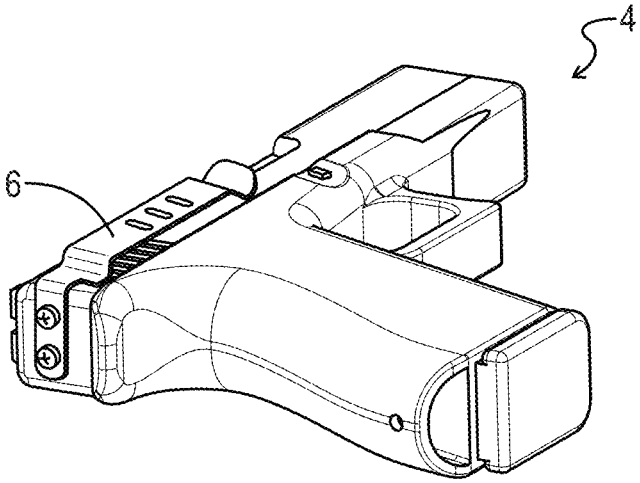
FIG. 9 is an isometric view of a handgun having a retaining clip securely mounted to the firearm for in the waistband carry of the firearm.

The concealed carry apparatus 10 disclosed herein advantageously provides a rigid frame to which a firearm or a holster for a firearm can be firmly attached and stably supported. The rigidity of the support tongue 18 allows a user to more quickly and safely draw the firearm (whether the firearm is holstered or directly attached to the tongue 18 via an integral clip 6 as shown in FIG. 9) by providing a substantially rigid support structure from which a user can draw their firearm or knife with minimal to no holster or belt movement. Preventing movement of the holster 2 and belt 12 during drawing of the firearm prevents the belt 12 and holster 2 from binding up the draw, and allows the firearm 4 to clear the holster 2 and belt 12 sooner than other currently available gun belts which rely on attachment of the holster and/or firearm directly to a flexible strap.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful APPARATUS FOR CARRYING CONCEALED WEAPONS it is not intended that such references be construed as limitations upon the scope of this invention except as set forth in the following claims.

What is claimed is:

1. An apparatus for supporting a concealed weapon on a waist of a user, said apparatus comprising:

a first fastener configured to attach to a waistband, wherein said waistband is configured to extend about the waist of the user;

a second fastener configured to attach to the waistband;

a support tongue configured to extend between the first fastener and the second fastener such that the support tongue is supported on the waistband by the first and second fasteners, wherein:

the support tongue is configured to receive and support a mount for the concealed weapon;

when the support tongue is in an upright position, the support tongue is resiliently flexible in a horizontal direction and substantially rigid in a vertical direction;

the support tongue has a first end and a second end opposite the first end;

the second fastener is attached to the support tongue at the second end of the support tongue;

the first fastener is a keeper loop;

the support tongue is formed of carbon fiber; and the support tongue is angled at the first end of the support tongue such that the support tongue is shorter along a bottom of the support tongue than at a top of the support tongue when the support tongue is in the upright position to promote insertion of the first end of the support tongue into the keeper loop while maintaining rigidity during drawing of the concealed weapon.

2. The apparatus of claim 1, wherein:

the upright position of the support tongue is when worn by the user in a standing, generally vertical orientation.

3. The apparatus of claim 1, wherein:

when the support tongue is in the upright position, the support tongue is between 0.75 and 2.5 inches tall;

when the support tongue is in the upright position, the support tongue is between 4 and 20 inches long; and when the support tongue is in the upright position, the support tongue is between 1/16 inch thick and 1/4 inch thick.

4. The apparatus of claim 1, wherein:

when the support tongue is in the upright position, the support tongue is 1.25 inches tall;

when the support tongue is in the upright position, the support tongue is 11.5 inches long; and when the support tongue is in the upright position, the support tongue is ⅛ inches thick.

5. The apparatus of claim 1, wherein:

the first and second fasteners are one of clips, hooks, loops, or hook and loop systems.

6. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another; and the first fastener extends inward from the inner surface of the belt when the user is wearing the apparatus and is configured to receive the first end of the support tongue therein to attach the support tongue to the belt when the user is wearing the apparatus.

7. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the first fastener extends inward from the inner surface of the belt when the user is wearing the apparatus and is configured to receive the first end of the support tongue therein to attach the support tongue to the belt when the user is wearing the apparatus; and the second fastener slidably engages the inner surface of the belt.

8. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the first fastener extends inward from the inner surface of the belt when the user is wearing the apparatus and is configured to receive the first end of the support tongue therein to attach the support tongue to the belt when the user is wearing the apparatus; and the second fastener is a mounting loop extending about the belt such that the second fastener and the support tongue can be slid along the belt between the first end portion and the second end portion of the belt.

9. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another; and the first fastener extends about the belt when the user is wearing the apparatus such that the first fastener is slidable along the belt between the first end portion and the second end portion of the belt, and the first fastener is configured to receive the first end of the support tongue therein to attach the support tongue to the belt when the user is wearing the apparatus.

10. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another; and the belt is formed by overlapping two sections of flexible strap and securing the two sections of flexible strap to one another at spaced intervals along a length of the belt to form anchor loops along the length of the belt.

11. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another; and the belt is formed from a flexible strap folded lengthwise to form two overlapping sections of flexible strap which are secured to one another at spaced intervals along a length of the belt to form anchor loops along the length of the belt.

12. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the belt is formed by overlapping two sections of flexible strap and securing the two sections of flexible strap to one another at spaced intervals along a length of the belt to form anchor loops along the length of the belt; and the two sections of flexible strap are secured to one another at spaced intervals by sewing the straps together transverse to the length of the belt.

13. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the belt is formed by overlapping two sections of flexible strap and securing the two sections of flexible strap to one another at spaced intervals along a length of the belt to form anchor loops along the length of the belt;

the two sections of flexible strap are secured to one another at spaced intervals by sewing the straps together with columns of vertical stiches transverse to the length of the belt such that anchor loops are formed by the overlapping sections of flexible strap between each successive row of vertical stitching; and a plurality of the anchor loops are configured to receive a portion of the buckle therein to secure the belt about the waist of the user.

14. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the belt is formed from a flexible strap folded lengthwise to form two overlapping sections of flexible strap which are secured to one another at spaced intervals along a length of the belt to form anchor loops along the length of the belt; and the buckle is a G hook, the flexible strap is inserted in the G hook and folded lengthwise to capture the G hook at the fold in the flexible strap.

15. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

a height of the belt is greater than a height of the support tongue when the user is wearing the apparatus.

16. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the belt is formed by overlapping two sections of flexible strap and securing the two sections of flexible strap to one another at spaced intervals along a length of the belt to form anchor loops along the length of the belt; and the flexible strap is elastic.

17. The apparatus of claim 1, wherein:

the concealed weapon is a holstered handgun;

the support tongue is configured to receive the mount of the holstered handgun when the apparatus is worn by the user.

18. The apparatus of claim 1, wherein:

the apparatus further comprises a belt forming the waistband of the user when the apparatus is being worn by the user, said belt having an inner surface, a first end portion, a second end portion opposite the first end portion, and a buckle, wherein the buckle is configured to releasably secure the first end portion and the second end portion to one another;

the mount of the concealed weapon is a retaining clip;

a space is formed between the support tongue and the inner surface of the belt when the apparatus is worn by the user, and the retaining clip of the concealed weapon is receivable in the space to attach the concealed weapon to the support tongue;

the concealed weapon is a handgun in a holster;

the retaining clip attaches the holster to the support tongue;

the holster supports the handgun;

the retaining clip is concealed from view when the apparatus is being worn about the waist of the user and the holster is attached to the support tongue via the retaining clip.

19. An apparatus for supporting a concealed weapon on a waist of a user, said apparatus comprising:

a first fastener configured to attach to a waistband, wherein said waistband is configured to extend about the waist of the user;

a second fastener configured to attach to the waistband;

a support tongue configured to extend between the first fastener and the second fastener such that the support tongue is supported on the waistband by the first and second fasteners, wherein:

the support tongue is configured to receive and support a mount for the concealed weapon;

when the support tongue is in an upright position, the support tongue is resiliently flexible in a horizontal direction and substantially rigid in a vertical direction;

the support tongue has a first end and a second end opposite the first end;

the second fastener is attached to the support tongue at the second end of the support tongue;

the first fastener is a keeper loop; and the support tongue is formed of carbon fiber.

20. An apparatus for supporting a concealed weapon on a waist of a user, said apparatus comprising:

a first fastener configured to attach to a waistband, wherein said waistband is configured to extend about the waist of the user;

a second fastener configured to attach to the waistband;

a support tongue configured to extend between the first fastener and the second fastener such that the support tongue is supported on the waistband by the first and second fasteners, wherein:

the support tongue is configured to receive and support a mount for the concealed weapon;

when the support tongue is in an upright position, the support tongue is resiliently flexible in a horizontal direction and substantially rigid in a vertical direction;

the support tongue has a first end and a second end opposite the first end;

the second fastener is attached to the support tongue at the second end of the support tongue;

the first fastener is a keeper loop; and the support tongue is angled at the first end of the support tongue such that the support tongue is shorter along a bottom of the support tongue than at a top of the support tongue when the support tongue is in the upright position to promote insertion of the first end of the support tongue into the keeper loop while maintaining rigidity during drawing of the concealed weapon.

* * * * *